United States Patent [19]

Schutt

[11] Patent Number: 5,055,166

[45] Date of Patent: Oct. 8, 1991

[54] SURFACE MOUNTED CATHODIC PROTECTION ANODE AND METHOD OF USE

[75] Inventor: William R. Schutt, Doylestown, Pa.

[73] Assignee: Matcor, Inc., Doylestown, Pa.

[21] Appl. No.: 947,010

[22] Filed: Dec. 29, 1986

[51] Int. Cl.[5] ..... C23F 13/00

[52] U.S. Cl. ..... 204/147; 204/196

[58] Field of Search ..... 204/147, 148, 196, 197

[56] References Cited

U.S. PATENT DOCUMENTS

| | | | |
|---|---|---|---|
| 4,255,241 | 3/1981 | Kroon et al. | 204/196 |
| 4,502,929 | 3/1985 | Stewart et al. | 204/147 |
| 4,692,066 | 9/1987 | Clear | 204/196 |

FOREIGN PATENT DOCUMENTS

| | | | |
|---|---|---|---|
| 2140456A | 11/1984 | United Kingdom | 204/196 |

OTHER PUBLICATIONS

"Ferex 100", Raychem brochure, *Cathodic Protection Anode for the Prevention of Corrosion in Concrete,* Feb. 1984, 2 pages.

Publication of Matcor, Inc. entitled "Steel-in-Concrete Corrosion & Cathodic Protection", Publication No. D-185, © 1985 Matcor, Inc., pp. 16-31.

*Primary Examiner*—T. Tung

*Attorney, Agent, or Firm*—Caesar, Rivise, Bernstein, Cohen & Pokotilow, Ltd.

[57] ABSTRACT

Methods of cathodically protecting structures, anode assemblies used therein and the structures protected thereby. One embodiment of the structure basically consists of a base layer of concrete and, in the case of paved structures, an overlay material disposed over the base layer. One method comprises disposing at least one elongated, electrically conductive, wire anode directly on the concrete base layer. The anode is an elongated wire of small diameter and is arranged to be connected to a source of positive potential. A strip of a mesh material having an adhesive thereon is disposed over the anode and secured directly to the concrete base so that the anode is interposed and held between the strip and the concrete base in electrical engagement therewith. Unset electrically conductive polymer concrete is then disposed over the mesh strip so that it flows through the openings in the strip to electrically conductively engage the anode and the concrete base layer to encapsulate the anode and to intimately engage the base layer. The electrically conductive polymer concrete is smoothed before it sets to form a generally flat layer strip of minimal height and not extending substantially beyond the marginal edges of the mesh strip. A thin overlay material can then be disposed over the base layer and conductive concrete material strip to form a generally smooth upper surface for the structure. Another method entails forming a preformed anode assembly having the elongated wire anode covered with an elongated strip of mesh, both encapsulated in a strip of conductive concrete. The preformed anode assembly is arranged to be adhesively secured to a structure to be cathodically protected.

6 Claims, 2 Drawing Sheets

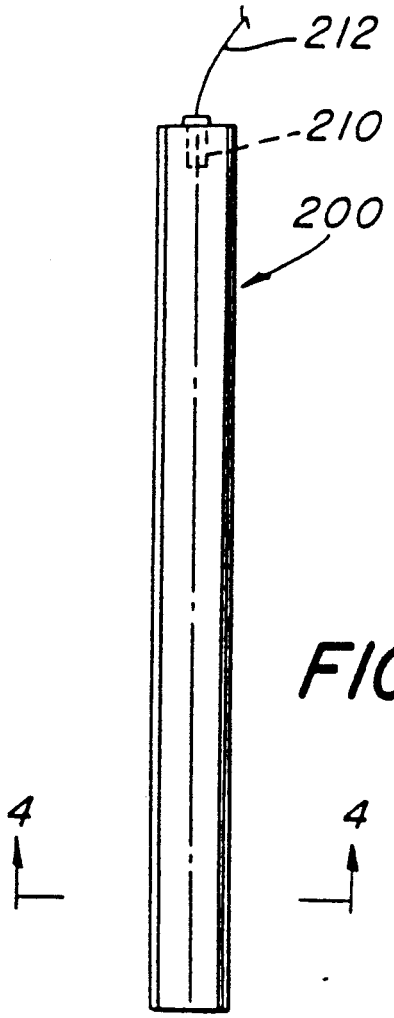
FIG. 3
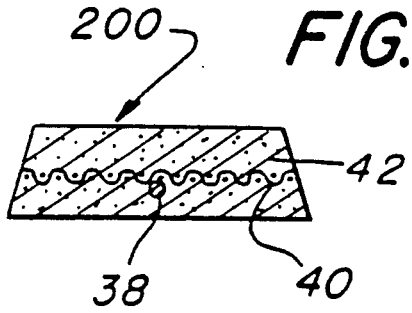
FIG. 4
FIG. 5
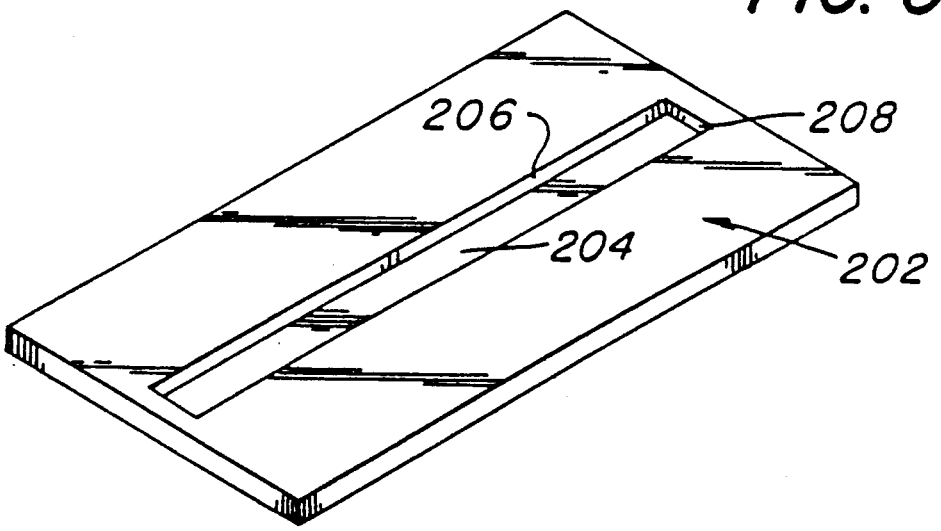

SURFACE MOUNTED CATHODIC PROTECTION ANODE AND METHOD OF USE

BACKGROUND OF THE INVENTION

This invention relates generally to cathodic protection systems and more particularly to cathodic protection systems for steel-in-concrete structures.

In order to protect steel-in-concrete structures, such as roadways or bridges having a concrete base layer in which steel reinforcing bars are located, various cathodic protection systems have been utilized. In all such systems, an anode or a string of anodes is either laid on the concrete or embedded in it. The anode(s) is(are) connected in a circuit containing a rectifier and the steel reinforcing bars. The current from the rectifier is sent through the circuit wiring to the anode at which point is passes through the concrete itself to the reinforcing bars and from there through a negative return cable to the rectifier.

One type of cathodic protection system is sometimes referred to as an asphalt overlay system. That system basically comprises disposing a plurality of flexibly interconnected, cast iron anodes on the concrete deck or base to be protected and cementing them in place thereon. The anodes are connected (wired) to a rectifier controller. Over the top of the anodes an asphalt layer is laid. That layer usually includes a conductive carbon particulate material (commonly referred to as "coke breeze") used as an aggregate. Disposed over the coke breeze asphalt layer is a conventional asphalt layer. While that cathodic protection system is generally suitable for its purposes, it nevertheless exhibits certain disadvantages, such as weight, replaceability, limited fields of use (e.g., horizontal surfaces) and relatively high cost.

An alternative to the asphalt overlay system are so-called "non-overlay" systems. These systems were developed to overcome the problems of the overlay system and basically consists of two types, namely, the so-called "non-overlay with conductive concrete" system, and the so-called "non-overlay with conductive paint" system. In the non-overlay systems, the anode utilized is frequently a small diameter, e.g., one-eighth inch or less, platinum coated wire.

In one non-overlay system, a series of saw slots are cut in the concrete base layer at spaced locations and a respective platinum wire anode is disposed in each of the saw slots. Those slots are thereafter filled with a conductive concrete grout. The anodes are connected to the rectifier so that D-C. current is discharged from the conductive slots, which thus act as anodes. The current then passes through the concrete to the reinforcing bars and back to the rectifier. While the saw-slot mounted anode, non-overlay system has advantages over the overlay system, it nevertheless suffers from various disadvantages, such as a relatively high cost of installation (the saw slots must be cut in the concrete, cleaned of all debris and then platinum anodes placed in the slots and the conductive ground placed in the slots containing the anodes).

An alternative to the saw-slot non-overlay system has been developed and basically consists of pre-casting the platinum wire anode in a conductive polymer strip approximately one and one-half inches width and three-quarter inch height, then placing the pre-cast polymer anode in place on the surface of the concrete base. While this technique has obviated the necessity of cutting the saw slots and filling them, the formation of such pre-cast anodes is somewhat difficult and they are susceptible to breakage in handling.

Another alternative to a non-overlay system comprises placing the wire anode directly on the surface of the concrete base layer, providing forms (molds) on either side thereof and pouring a polymer concrete into the space between the forms to encapsulate the anode therein. Such a technique (called a "poured-in-place" technique), while offering certain advantages over the use of pre-cast anodes or saw slot disposed anodes, nevertheless is difficult and expensive to accomplish since it requires the use of forms of some sort which have to be placed adjacent the anode to form the polymer concrete strip and then removed after the formation of the strip. Thus, for long structures to be protected, thousands of feet of forms could be required. Moreover, the prior art poured-in-place methods of forming a non-overlay system exhibits the disadvantage that the poured-in-place polymer concrete strip formed thereby is relatively thick, e.g., one-half inch. Hence, if an overlay layer were needed to be placed over the concrete base layer the overlay would have to be thick to cover the poured-in-place concrete strip.

For cathodically protecting some installations, but not roadways, a non-overlay, conductive paint cathodic protection system was developed. That system basically consists of applying a conductive paint (a mastic) completely over the surface of the concrete layer having the reinforcing bars therein. Thereafter, a series of the small diameter platinum wires are attached to the concrete paint layer utilizing strips of self-adhesive fiberglas mesh. The mesh is then covered with another layer of conductive mastic. The anode system is completed and covers the entire concrete surface. A cosmetic acrylic paint can then be put over the mastic, if desired.

While this system is generally suitable for its intended purposes, and offers advantages over various other cathodic protection systems, it still leaves something to be desired. In this connection such a system cannot be used if a concrete overlay layer is to be placed over the base layer, nor may the mastic material provide sufficient mass to ensure long system life.

OBJECTS OF THE INVENTION

Accordingly, it is a general object of the instant invention to provide apparatus and a method for cathodically protecting structures, and the structures formed thereby, which overcome the disadvantages of the prior art.

It is still a further object of the instant invention to provide apparatus and methods for cathodically protecting structures the structures produced thereby and which apparatus are low in cost and can be readily used to effect the methods.

It is still a further object of this invention to provide a method of preforming an anode assembly, the anode assembly formed itself, and the method of using the preformed anode assembly to cathodically protect a structure.

SUMMARY OF THE INVENTION

These and other objects of the instant invention are achieved by providing apparatus and methods for cathodically protecting structures and to the structures formed thereby. In one embodiment, the structure is paved and includes a base layer of concrete and an overlay layer disposed over the base layer.

One method comprises disposing at least one elongated, electrically conductive, wire anode directly on the concrete base layer. The anode is of small diameter and arranged to be connected to a source of positive potential. A strip of a mesh material having an adhesive thereon is disposed over the anode to secure it directly to the concrete base layer so that the anode is interposed and held therebetween. An unset, electrically conductive polymer concrete is placed over the mesh strip so that it flows through the openings in the strip to electrically conductively engage the anode and the concrete base layer and to encapsulate the anode therein. The unset, electrically conductive, polymer concrete is smoothed before it sets to form a generally flat layer or strip of minimal height and not extending substantially beyond the marginal edges of the mesh strip. A thin overlay material layer can then be disposed over the base layer and the conductive concrete material strip to form a generally smooth upper surface for the structure.

In another embodiment, an anode assembly for cathodically protecting a structure is preformed by providing molding means for forming the assembly. Unset electrically conductive concrete is placed on the molding means in a strip, an electrically conductive, elongated wire anode is placed on the concrete strip with an elongated strip of flexible mesh material disposed thereover. Additional unset electrically conductive concrete is placed over the mesh material to encapsulate it and the anode in the concrete. The assembly is allowed to set to form a preformed elongated anode. That anode is arranged to be adhesively secured to the structure to be protected so that good electrical continuity exists therebetween.

DESCRIPTION OF THE DRAWING

FIG. 3 is a plan view of an alternative embodiment of a cathodic protection system anode assembly;

FIG. 4 is an enlarged sectional view taken along line 4—4 of FIG. 3; and FIG. 5 is a perspective view of a mold for forming the anode assembly of FIGS. 3 and 4.

DETAILED DESCRIPTION OF THE PREFERRED EMBODIMENT

Figure 1:
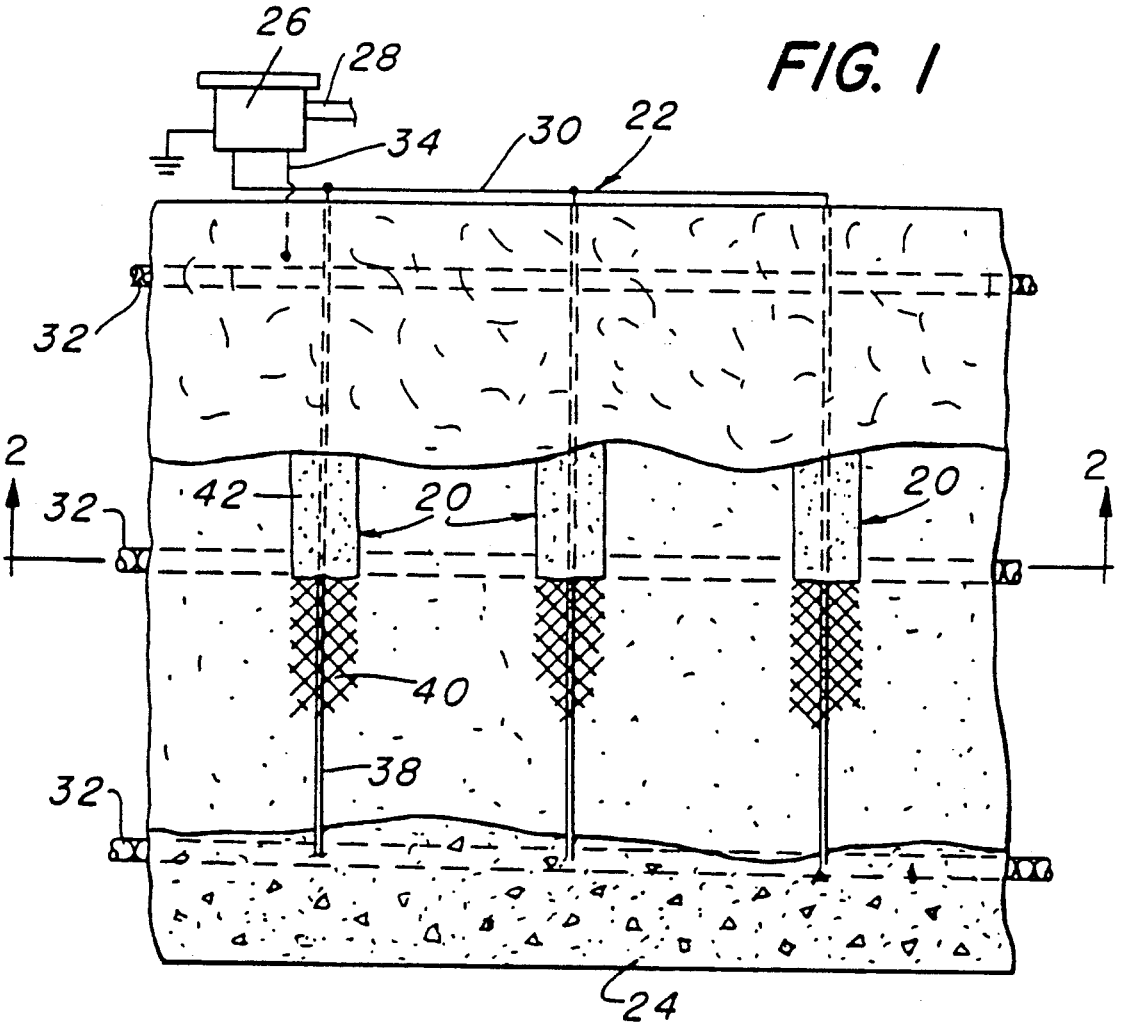
FIG. 1 is a top plan illustration of a cathodic protection system utilizing one embodiment of an anode assembly of the subject invention.

Referring now to the various figures of the drawing wherein like reference characters refer to like parts, there is shown generally at 20 plural anode assemblies constructed in accordance with the subject invention and interconnected in a system 22 to cathodically protect steel-in-concrete structures 24.

As is known, the spalling of bridges and highways, the rapid deterioration of buildings, parking garages, piers and marine structures is due in large part to the corrosion of the embedded reinforcing steel bars. Cathodic protection systems have been shown to be the only effective method of totally and instantly stopping the corrosion process. The cathodic protection of steel-in-concrete typically requires an impressed current cathodic protection system. Such a system is shown by the reference numeral 22 and basically comprises a DC source, e.g., a rectifier 26 which takes AC current via lines 28 and converts it to DC current. The DC current is provided from one output via conductors 30 to a plurality of parallelly connected anode assemblies 20. The current flows from the anode assemblies through the underlying concrete 24 to the embedded steel reinforcing bars 32. The current then passes from the reinforcing bars back through a return wire or cable 34. The return cable is thus connected to the reinforcing bars and to the other side of the output of the rectifier 26.

Figure 2:
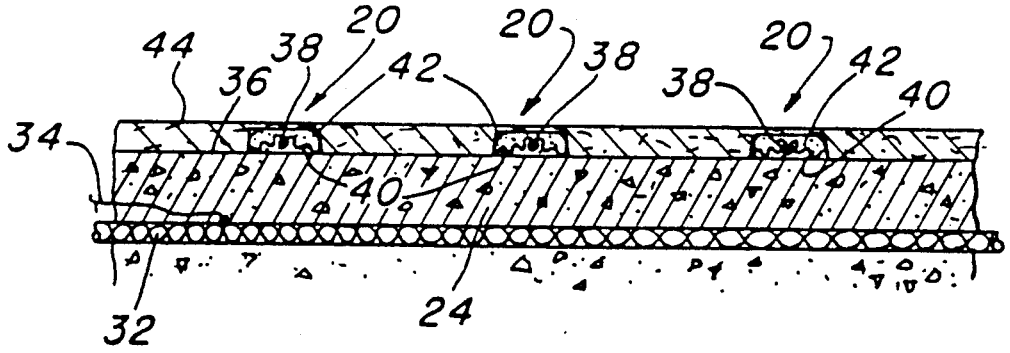
FIG. 2 is a sectional view taken along line 2—2 of FIG. 1.

In accordance with the teachings of the subject invention, the plural anode assemblies 20 are disposed on the surface of the concrete body 24 and are secured thereto so that there is good electrical continuity therebetween. In the embodiment shown in FIG. 1, the anode assemblies 20 are formed or poured in place on the concrete body 24. To that end, as can be seen in FIGS. 1 and 2, each of the anode assemblies 20 basically comprises an elongated small diameter, wire anode 38 such as an elongated platinum coated wire sold by Applicant's assignee, Matcor, Inc., of Doylestown, Pa., under the registered Trademark PL. A strip or elongated web of fiberglass mesh 40, having an adhesive on the underside thereof, is disposed over the anode wire 38 to secure the anode wire in place on the surface 36 of the concrete body 24. Thereafter unset, electrically-conductive, polymer concrete is applied (e.g., poured) in a strip 42 along the length of web 40 so that the polymer concrete covers that web and passes through its interstices to engage the surface 36 of the concrete body 24, thereby encapsulating the anode 38 in the polymer concrete. The conductive polymer concrete is either allowed to naturally smooth off or else is smoothed by a trowel so that the height of the conductive strip 42 is relatively low, e.g., ⅛ inch (0.32 cm), with a generally planar top surface. As can be seen clearly in FIGS. 1 and 2, the width of the conductive concrete 42 is just slightly beyond the width of the fiberglass mesh 40. In the preferred embodiment of the invention, the width of the strips 42 is approximately two inches (5 cm). When the polymer concrete strip 42 sets, the anode assembly 20 is completed and is fixedly secured in good electrical continuity with the concrete body 24.

Inasmuch as the strips 42 are of short height, a thin overlayer material 44, such as asphalt or concrete of ¼ inch (0.63 cm) thickness, can be applied over the concrete body 24 to complete a cathodically protected paved surface.

In the embodiment shown in FIG. 3, there is shown a preformed anode assembly 200. The anode 200 is basically similar in construction to the poured-in-place anode assembly 20 described heretofore, except that it is preformed and not formed on the concrete body to be protected.

The anode assembly 200, is particularly suited for use in applications wherein formation or pouring in place is not possible or desirable. Examples of such applications are to cathodically protect the piles of concrete piers, or other vertically disposed surfaces.

Thus, as can be seen in FIGS. 3 and 4, the anode assembly 200 basically comprises an elongated platinum coated wire anode 38 (like that of the embodiment of FIG. 1), and over which is disposed an elongated strip of fiberglass mesh material 40 (also like that described with reference to FIG. 1). The anode wire and mesh are all encapsulated or encased in an elongated strip 42 formed of an electrically conductive polymer concrete.

As can be seen in FIG. 4, the cross-sectional shape of the anode assembly 200 is trapezoidal, that is, the strip has an upper surface, a lower surface and a pair of outwardly tapering side surfaces in order that it can be readily molded and removed from the mold.

In FIG. 5 there is shown an aluminum mold for forming the anode assembly 200. As can be seen, the mold at 202 basically comprises a recess having a bottom surface 204, and opposed inclined pair of side surfaces 206 (only one of which can be seen) and a pair of vertically oriented end surfaces 208 (only one of which can be seen).

The formation of the anode assemble 200 in mold 202 is as follows: a thin layer of unset, electrically conductive, polymer concrete is disposed in the recess all along its bottom surface 204. An elongated wire anode 38 is then disposed over the unset concrete and along virtually the entire length of the mold cavity. An electrical conductor 210 is secured to one end of the anode 38. The connector 210 serves as a means for connecting the anode 38 to a cable 212 (See FIG. 3) for connection to the rectifier 26. An elongated strip of fiberglass mesh 40 is then applied over the anode wire 38 and in engagement with the top surface of the conductive concrete strip disposed thereunder. Further unset, electrically conductive, polymer concrete is then poured into the mold 202 until it fills the entire mold cavity. Once the polymer concrete has set, the anode assembly 200 is removed from the mold and is now ready for disposition on the concrete structure to be protected.

The use of the fiberglass mesh disposed within the preformed anode assembly 200 serves to not only hold the anode wire in place during the fabrication process but also serves as reinforcing means for the anode assembly to prevent the anode from cracking or otherwise breaking during handling.

The anode assemblies 200 are arranged to be secured to a structure to be protected by merely adhesively securing them in place on the structure, in order to provide good electrical conductivity therewith. The anode assemblies are then connected to the system 22 in the same manner as described with reference to FIG. 1.

In accordance with one preferred embodiment of this invention, the preformed anode assembly 200 is preferably ¼ inch high (0.63 cm), 2 inches wide (5 cm) and in lengths of from two to four feet long (61–122 cm). It should be pointed out that the preformed anode assembly 200 can be formed in any shape to conform to the structure to be protected.

Without further elaboration the foregoing will so fully illustrate my invention that others may, by applying current or future knowledge, adopt the same for use under various conditions of service.

I claim:

1. A method of cathodically protecting a structure including a layer of concrete, said layer including an exposed surface and metal reinforcing members therein, said method comprising the steps of: connecting the metal reinforcing members to a power source for forming cathodes, providing at least one elongated, preformed anode assembly to be secured to said exposed surface, said assembly comprising a strip of mesh material disposed over an elongated electrically conductive wire anode, said mesh material and said anode being embedded within the interior of an elongated strip of electrically conductive concrete, placing said anode assembly on said exposed surface with an adhesive material interposed between the conductive concrete of the anode assembly and the exposed surface to fixedly secure said anode assembly to said layer of concrete with good electrical continuity therebetween, and thereafter connecting said anode assembly to an electrical power source.

2. A preformed anode assembly for attachment to a structure having metal members therein for cathodically protecting said structure, said anode assembly comprising a strip of mesh material disposed over an elongated electrically conductive wire anode, said mesh material and said anode being embedded within the interior of an elongated strip of electrically conductive concrete, said mesh material reinforcing said assembly and holding the anode in proper position during the fabrication of said assembly, said elongated strip being arranged to be secured to the structure to be cathodically protected.

3. The anode assembly of claim 2 wherein said elongated strip of electrically conductive concrete is thin and has a generally planar upper and lower surface.

4. The anode assembly of claim 3 wherein said elongated strip of electrically conductive concrete is approximately 2 inches wide and ¼ inch thick.

5. The anode assembly of claim 4 wherein said concrete is a polymer concrete, said mesh is a fiberglas mesh and said anode comprises a platinum coated wire.

6. The preformed anode assembly of claim 2 wherein said elongated strip of electrically conductive concrete is approximately ¼ inch thick.

* * * * *